United States Patent [19]

Luke

[11] Patent Number: 4,727,888

[45] Date of Patent: Mar. 1, 1988

[54] SMOKING ARTICLES

[75] Inventor: John A. Luke, Eastleigh, Great Britain

[73] Assignee: British-American Tobacco Company Limited, London, England

[21] Appl. No.: 821,542

[22] Filed: Jan. 22, 1986

[30] Foreign Application Priority Data

Feb. 1, 1985 [GB] United Kingdom ..... 8502651

[51] Int. Cl.[4] ..... A24C 5/18

[52] U.S. Cl. ..... 131/84.1; 131/360; 131/364

[58] Field of Search ..... 131/84.1, 364

[56] References Cited

U.S. PATENT DOCUMENTS 3,614,956 10/1971 Thornton ..... 131/364

*Primary Examiner*—V. Millin

*Attorney, Agent, or Firm*—Kane, Dalsimer, Sullivan, Kurucz, Levy, Eisele and Richard

[57] ABSTRACT

In the making of cigarette rod, which rod comprises an axial element of filler material and a wrapper surrounded by smoking material and an exterior wrapper, a web of the exterior wrapper material, a stream of the smoking material and a preformed rod, providing the axial element, are fed to the garniture of a cigarette rod making machine. The rod providing the axial element is made on a further rod making machine.

10 Claims, 2 Drawing Figures

SMOKING ARTICLES

BACKGROUND OF THE INVENTION

1. Field of the Invention

This invention relates to smoking articles, smoking article rods of which comprise a longitudinally extending interior zone of a constitution different from that of filler disposed outside the zone.

2. Brief Description of the Prior Art

The patents literature contains numerous references to cigarettes and cigars comprising an axial zone of a constitution different from that of tobacco filler material disposed outside the zone. According to French Patent Specification No. 1,322,254 a cigar or cigarette contains a further cigar or cigarette. The contained smoking article extends from the mouth end of the containing smoking article over about two-thirds the length of the latter. At its upstream end the contained smoking article is sealed and remains sealed until, upon approach of the coal of the containing smoking article, the seal is consumed.

There is disclosed in French Patent Specification No. 998,556 a cigarette an axial zone of which is comprised of a low quality tobacco and an annular zone of which, surrounding the axial zone, is comprised of high quality tobacco.

In U.S. Pat. No. 3,614,956 there is disclosed a cigarette comprising an axial core of absorbent material, charcoal or alumina for example, surrounded by tobacco. The absorbent material is contained in a tube of ceramic material which is, in turn, wrapped in a sleeve of smoke-impervious paper. At the mouth end, the tobacco zone is closed to smoke flow.

U.S. Pat. No. 4,219,031 discloses a cigarette comprising a self-supporting axial core of carbonised material surrounded by tobacco.

A cigarette comprising a longitudinally extending fine filament treated with a smoke-modifying agent is disclosed in United Kingdom Patent Specification No. 2 070 409 A.

Cigarettes and cigars comprising axially disposed tubes formed of tobacco leaf are disclosed in United Kingdom Patent Specification No. 232,819.

United Kingdom Patent Specification No. 1,086,443 presents a disclosure of a cigarette an axial zone of which contains no tobacco or tobacco at a low packing density.

Numerous proposals have been made for methods of making cigarettes comprising an axial zone of a first tobacco and a concentric layer of a second tobacco. Such methods are disclosed in U.S. Pat. No. 1,829,559 and UK Patent Specification Nos. 1,054,557; 1,305,900; 1,416,020; 1,475,494; 1,541,339; 2 132 068 A and 2 133 966 A.

SUMMARY OF THE INVENTION

It is an object of the present invention to provide a method of making smoking article rod an axial zone of which is of a constitution different from that of smoking material disposed outside the zone, by which method rod of very consistent and well defined construction can be produced at high production speeds.

The present invention provides a method of making composite smoking article rod, wherein there are fed simultaneously to the garniture of a rod making machine a web of first wrapper material, a stream of smoking material and a preformed rod comprising filler material wrapped in second wrapper material, whereby in said garniture said first wrapper material is wrapped about said preformed rod and said smoking material.

The preformed rod is advantageously fed to the garniture of the rod making machine directly from the garniture of a further rod making machine, preferably along a substantially straight feed path. If the first mentioned making machine is of the commonly employed type which comprises to the entry end of the garniture a smoking material conducting chimney upwardly extending to a smoking material conveying suction band, the feed path of the preformed rod suitably extends close to the conveying run of the suction band.

The first wrapper material and/or the second wrapper material may be cigarette paper. Tobacco leaf or a tobacco based sheet material may be used for one or both of the first and second wrapper materials. Each of the first and second wrapper materials should be combustible and the first wrapper material, at least, should be of an air permeability of five Coresta units or more. The second wrapper material may comprise or be treated with a smoke-modifying agent.

Preferably, the preformed rod is of constant cross-sectional size and shape. The shape of the cross-section of the preformed rod may be circular or non-circular. The peripheral configuration of the composite smoking article rod in cross-section is also preferably of constant size and shape. In this case too the shape may be circular or non-circular.

The preformed rod is suitably disposed coaxially of the composite smoking article rod.

The smoking material and/or the filler material may comprise cut tobacco. Other materials usable for, or in, one or both materials are reconstituted tobaccos and tobacco substitute materials. Suitably, the smoking material extends continuously of the composite smoking article rod. It is also suitable that the filler extends continuously of the preformed rod.

The pressure drop, measured for example in cm WG, over unit length of the preformed rod may be the same as or different from that of the body of smoking material over unit length in the composite rod.

The present invention further provides a smoking article rod making apparatus comprising a first rod making machine, said first machine being operable to enwrap smoking material and a preformed rod in first wrapper material to provide composite smoking article rod, a second rod making machine, said second machine being operable to enwrap filler material in second wrapper material to provide said preformed rod, and feed means permitting the feed of said preformed rod from said second machine to said first machine.

Preferably, a rod making garniture of the second rod making machine is colinear with a rod making garniture of the first rod making machine.

BRIEF DESCRIPTION OF THE DRAWINGS

In order that the present invention may be clearly understood and readily carried into effect, reference will now be made, by way of example, to the accompanying drawing, in which.

DETAILED DESCRIPTION OF THE PREFERRED EMBODIMENTS OF THE INVENTION

Figure 1:
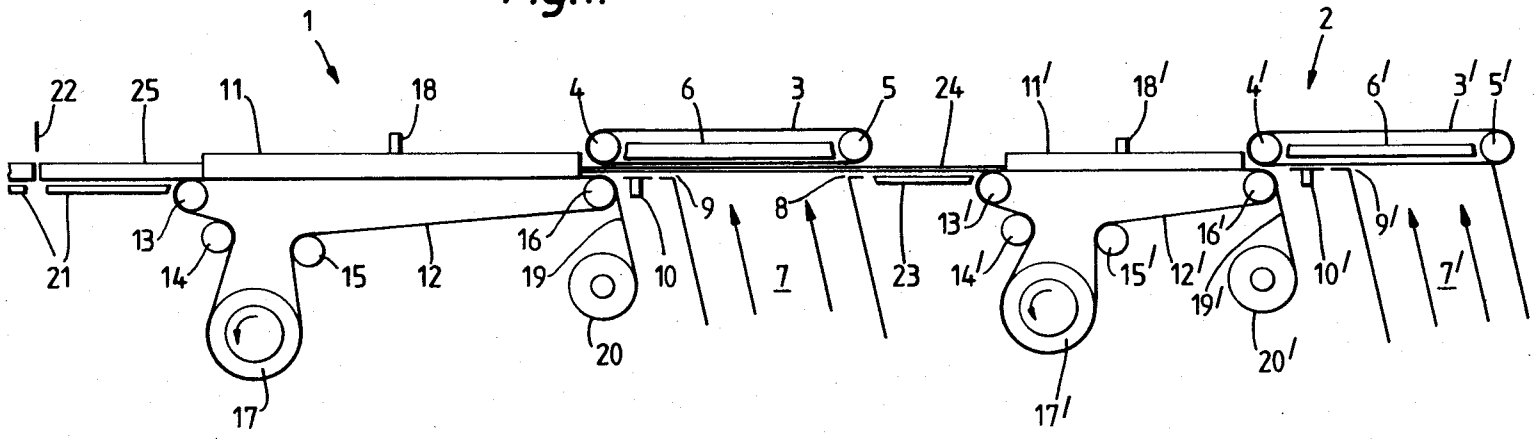
FIG. 1 shows apparatus operable to make composite cigarette rod.

The apparatus of FIG. 1 comprises a first cigarette rod making machine generally designated by reference numeral 1 and a second cigarette rod making machine generally designated by reference numeral 2. The machine 1 is operable to make circular cross-section cigarette rod of an orthodox diameter dimension, 8 mm say, whereas the machine 2 is operable to make circular cross-section cigarette rod of a lesser diameter dimension, 3 mm for example.

The machine 1 comprises an endless suction band 3 of air pervious material trained about pulleys 4 and 5, one of which pulleys is drivable, in a clockwise direction as viewing FIG. 1, by drive means (for the sake of simplicity not shown). There is disposed above the lower run of the band 3 a vacuum box 6. Disposed below the band 3 is an upwardly extending chimney 7, by which cut tobacco or other particulate smoking material may be conducted to the under face of the lower run of the band 3 under the action of a vacuum applied in the box 6. The tobacco or other smoking material is supplied to the lower end of the chimney 7 by supply means which is of known type and which, for the sake of simplicity, is not shown.

At the upper end of the chimney 7 and to the right as viewing FIG. 1 the chimney 7 is provided with a small opening, indicated by reference numeral 8, the purpose of which will become clear from the description hereinbelow. Tobacco adhering to the lower run of the suction band 3 passes from the chimney 7 through an exit gap indicated by reference numeral 9. A pair of disc knives, one of which, referenced 10, is shown in FIG. 1, are operable to trim surplus smoking material from that adhering to the band 3.

The machine 1 further comprises a rod making garniture 11 through which extends an endless garniture tape 12. Outside of the garniture 11 the tape 12 is trained about pulleys 13–16 and a drive pulley 17 which is drivable in an anti-clockwise direction by the drive means. Mounted at the garniture is an adhesive applicator 18 which is operable to apply lap seam adhesive to a margin of a continuous web 19 of cigarette paper which, in operation of the machine 1, is supplied from a reel 20. Extending from the outlet end of the garniture 11 is a guide bed 21 which serves to guide rod issuing from the garniture 11 past a rod severing knive indicated at 22.

The machine 2 is similar to the machine 1 although it is, as mentioned above, operable to make rod of lesser diameter than that of the rod made by machine 1. A difference between the machines 1 and 2 is that in the latter there is no opening corresponding to the opening 8 of the machine 1. Other than for this difference though, each of the above described components of the machine 1 is represented by a corresponding component in the machine 2. Thus the reference numerals used for the machine 2 in FIG. 1 correspond with those used for the machine 1 except that for the machine 2 the reference numerals are suffixed with a prime symbol.

Drive means is operable to provide drive to the machine 2 in synchronism with the drive provided to the machine 1.

A guide bed 23 extends between the outlet end of garniture 11′ of the machine 2 and the opening 8 at the chimney 7 of the machine 1, the bed 23 and the opening 8 constituting feed means.

In operation of the apparatus comprising machines 1 and 2, cut tobacco or other particulate filler material is provided continuously to chimney 7′ of the machine 2 by supply means which is of known type and which for the sake of simplicity is not shown. The filler material passes up the chimney 7′ under action of a vacuum applied in vacuum box 6′. The filler material is conveyed from the chimney 7′ as a stream formed at the lower run of suction band 3′ and surplus filler material is trimmed from the stream by a pair of disc knives of which knife 10′ is one. The trimmed stream of filler material is transferred onto cigarette paper web 19′ at entry to garniture 11′, the web 19′ and the stream of filler material being transported into and through the garniture 11′ by garniture tape 12′. Within the garniture 11′ the web 19′ is wrapped about the filler material in known manner and there issues from the outlet end of the garniture 11′ a small diameter continuous rod 24.

The rod 24 is fed continuously, in an unsevered condition, along the guide bed 23 to and through the opening 8 at the chimney 7 of the machine 1, whereby the rod 24 is fed directly from the machine 2 to the machine 1. As may be seen from FIG. 1, the feed path of the rod 24 extends close beneath the lower run of the suction band 3. The linear velocity of the band 3 is the same as that of the rod 24.

Particulate smoking material supplied continuously to chimney 7 passes thereup under the action of a vacuum applied in the vacuum box 6 and forms a stream at the lower run of the band 3, the depth of which stream at exit from the chimney 7 is such that the continuous rod 24 is surrounded by the smoking material of the stream. Even when surplus smoking material has been trimmed from the stream by the pair of disc knives of which 10 is one, the rod 24 extends within the stream. The trimmed stream of smoking material is transferred onto the cigarette paper web 19 at entry to the garniture 11. The web 19, the smoking material and the rod 24 are transported throught the garniture 11 under the action of the garniture tape 12. Within the garniture 11 the web 19 is wrapped about the smoking material, which smoking material is in turn disposed about the rod 24. There thus issues from the outlet end of the garniture 11 a composite cigarette rod 25 in which the rod 24 is axially disposed.

To facilitate operation of the apparatus the garnitures 11 and 11′ and the rod feed path therebetween are colinear.

Figure 2:
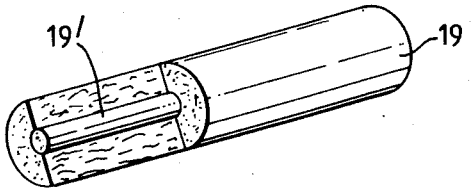
FIG. 2 shows a perspective view, partly cut away, of a cigarette rod length made on the apparatus of FIG. 1.

The rod 25 is then severed by the knife 22 to provide unit rod lengths. One such unit rod length is shown in FIG. 2.

What is claimed is:

1. A method of making composite smoking article rod, wherein there are fed simulataneously to the garniture of a rod making machine a web of first wrapper material, a stream of smoking material and a preformed rod comprising filler material wrapped in second wrapper material, whereby in said garniture said preformed rod is surrounded by said smoking material and said first wrapper material is wrapped about said smoking material.

2. A method according to claim 1, wherein said preformed rod is made in a further rod making machine.

3. A method according to claim 2, wherein said preformed rod is fed to the first mentioned rod making machine from said further cigarette making machine.

4. A method according to claim 3, wherein said preformed rod is fed in unsevered condition to said first mentioned rod making machine from said further rod making machine.

5. A method according to claim 1, wherein said smoking material comprises cut tobacco.

6. A method according to claim 1, wherein said filler material comprises smoking material.

7. A method according to claim 6, wherein said filler material comprises cut tobacco.

8. A method according to claim 1, wherein in said composite smoking article rod passing from said garniture said preformed rod is disposed coaxially of said composite rod.

9. Smoking article rod making apparatus comprising a first rod making machine, said first machine being operable to surround a preformed rod with smoking material and to enwrap said smoking material in first wrapper material to provide composite smoking article rod, a second rod making machine, said second machine being operable to enwrap filler material in second wrapper material to provide said preformed rod, and feed means permitting the feed of said preformed rod from said second machine to said first machine.

10. Apparatus according to claim 9, in which a rod making garniture of said second machine is colinear with a rod making garniture of said first machine.

* * * * *